US007656261B2

(12) United States Patent
Teng et al.

(10) Patent No.: US 7,656,261 B2
(45) Date of Patent: Feb. 2, 2010

(54) INTEGRATED MAGNETIC DEVICE AND CONDUCTIVE STRUCTURE THEREOF

(75) Inventors: Ching-Hsien Teng, Taoyuan Hsien (TW); Kao-Tsai Liao, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/236,311

(22) Filed: Sep. 23, 2008

(65) Prior Publication Data

US 2009/0278648 A1 Nov. 12, 2009

(30) Foreign Application Priority Data

May 6, 2008 (TW) ..... 97116686 A

(51) Int. Cl.
*H01F 27/29* (2006.01)

(52) U.S. Cl. ..... 336/192

(58) Field of Classification Search ..... 336/65, 336/83, 192, 200, 220–222, 232, 196, 198
See application file for complete search history.

(56) References Cited

U.S. PATENT DOCUMENTS 3,940,662 A * 2/1976 Quirke ..... 315/400
4,654,564 A * 3/1987 Lehnert ..... 315/400
7,286,374 B2 * 10/2007 Yasumura ..... 363/21.02
2006/0158303 A1 * 7/2006 Diekmann et al. ..... 336/234

* cited by examiner

*Primary Examiner*—Tuyen Nguyen
(74) *Attorney, Agent, or Firm*—Kirton & McConkie; Evan R. Witt

(57) ABSTRACT

An integrated magnetic device disposed on a system circuit board is disclosed. The integrated magnetic device comprises a bobbin, a magnetic core assembly, and a conductive structure. The bobbin has a main body for a primary winding to wind thereon and a channel piercing through the main body. The conductive structure comprises plural conductive units corresponded to each other and a first magnetic device. Each of the conductive units has a hollow portion, a receiving hole, and at least a conductive pin. The first magnetic device is electrically connected to the conductive units by the conducting part thereof piercing through the receiving holes of the conductive units. The conductive units are spaced by the main body of the bobbin, and the hollow portions of the conductive units are corresponded to the channel of the bobbin to receive parts of the magnetic core assembly, so as to assemble the bobbin, the magnetic core assembly and the conductive units as a second magnetic device. The first and second magnetic devices are integrated by the conductive structure and disposed on the system circuit board through the conductive pin of each of the conductive units of the conductive structure.

10 Claims, 8 Drawing Sheets

INTEGRATED MAGNETIC DEVICE AND CONDUCTIVE STRUCTURE THEREOF

FIELD OF THE INVENTION

The present invention relates to a magnetic device and the conductive structure thereof, and more particularly to an integrated magnetic device and the conductive structure thereof.

BACKGROUND OF THE INVENTION

Generally speaking, electronic equipment usually comprises many magnetic devices. Transformer is one of the common magnetic devices for regulating voltage base on electromagnetic energy conversion theory, so as to apply suitable voltage to the electronic equipment.

Take flyback transformer for example, it is usually electrically connected to another common magnetic device, such as choke coil, when the flyback transformer is disposed on a system circuit board of the electronic equipment. Please refer to FIG. 1, which is a schematic diagram showing the conventional transformer and choke coil disposed on the system circuit board. As shown in FIG. 1, the conventional transformer 10 and the choke coil 11 are respectively disposed on the system circuit board 1 through adhesive 12 and electrically connected to each other via the trace (not shown) of the system circuit board 1. However, a lot of space is occupied when the transformer 10 and the choke coil 11 are separately disposed on the system circuit board 1, and thus fragmentary space on the system circuit board 1 is formed. Therefore, the trend toward increasing the power and reducing the volume of the electronic equipment cannot be matched.

In addition, since the transformer 10 and the choke coil 11 are electrically connected to each other through the trace of the system circuit board 1, current resistance and waste may be occurred. Moreover, the transformer 10 and the choke coil 11 can be soldered on the predetermined position of the system circuit board 1 via solder 13 only after the wires are wound. However, for ensuring the soldering strength, the soldering place may be close to the wires wound on the transformer 10 and the choke coil 11. Hence the insulating material of the wires of the transformer 10 or the choke coil 11 may be damaged due to the high temperature during soldering process, and the safety and efficiency of the transformer 10 and the choke coil 11 may be impacted as well.

Therefore, it is required to develop an integrated magnetic device and the conductive structure thereof, so as to overcome the foregoing defects.

SUMMARY OF THE INVENTION

An object of the present invention is to provide an integrated magnetic device, so as to overcome the drawbacks caused by the transformer and the choke coil being separately disposed on the system circuit board and electrically connected to each other via the trace of the system circuit board. The integrated magnetic device comprises a conductive structure having plural conducting units and a first magnetic device. The conducting part of the first magnetic device penetrates through the receiving hole of each of the conductive units, so as to form the conductive structure. The conductive units, the bobbin, and the magnetic core assembly are assembled as a second magnetic device. Therefore, the first and second magnetic devices can be integrated as the integrated magnetic device, and the integrated magnetic device can be disposed on the system circuit board through the conductive pins of each of the conductive units. Since the first magnetic device is electrically connected to the second magnetic device through the conducting part directly in contact with the conducting units, the current resistance and waste can be reduced. Besides, the space utility of the system circuit board can be increased by the design of the integrated magnetic device of the present invention. The impacts to the first and second magnetic devices during the processing procedures can be prevented as well.

According to an aspect of the present invention, an integrated magnetic device is provided. The integrated magnetic device comprises: a bobbin having a main body for a primary winding to wind thereon and a channel piercing through the main body; a magnetic core assembly; and a conductive structure. The conductive structure comprises: a plurality of conductive units corresponded to each other and a first magnetic device. Each of the conductive units comprises a hollow portion, a receiving hole, and at least a conductive pin. The first magnetic device comprising a conducting part piercing through the receiving hole of each of the conductive units and electrically connected to the conductive units. The conductive units of the conductive structure are spaced by the main body of the bobbin, and the hollow portion of each of the conductive units is corresponded to the channel of the bobbin to receive parts of the magnetic core assembly, so as to assemble the bobbin, the magnetic core assembly and the conductive units of the conductive structure as a second magnetic device. The first magnetic device and the second magnetic device are integrated by the conductive structure and disposed on the system circuit board through the conductive pin of each of the conductive units of the conductive structure.

In an embodiment, the first magnetic device is a choke coil, and the second magnetic device is a transformer.

In an embodiment, the main body of the bobbin further comprises at least a winding section and at least a receiving portion. The primary winding is wound on the winding section, and the conductive units of the conductive structure are disposed at opposite sides of the main body and received in the receiving portion of the main body. The conductive units are served as the secondary winding of the second magnetic device.

In an embodiment, each of said conductive units comprises a plurality of conductive pieces and an insulating piece. Each of the conductive pieces has a loop portion, a first extension portion, and a second extension portion. The first extension portion has a through hole, and the second extension portion is substantially longer than the first extension portion. The insulating piece has a loop portion and is disposed between the conductive pieces. The loop portion of the insulating piece is corresponded to the loop portion of each of the conductive pieces for defining the hollow portion of each of the conductive units. The through holes of the first extension portions of the conductive pieces are corresponded to each other for defining the receiving hole of each of the conductive units. The second extension portion of each of the conductive pieces is applied as the conductive pin of each of the conductive units, wherein the second extension portions of the conductive pieces are staggered from each other in each of the conductive units.

In an embodiment, the conducting part of the first magnetic device is a terminal.

In an embodiment, the conducting part of the first magnetic device comprises a conductive stripe and a terminal of the first magnetic device. The terminal is connected to the conductive stripe, and the conductive stripe pierces through the receiving hole of each of the conductive units. The conductive stripe is selected from a metal material.

According to another aspect of the present invention, there is provided a conductive structure being disposed on a system circuit board and applied to an integrated magnetic device. The conductive structure comprises a plurality of conductive units and a first magnetic device. The conductive units are corresponded to each other and spaced at intervals. Each of the conductive units comprises a hollow portion, a receiving hole, and at least a conductive pin. Each of the conductive units is disposed on the system circuit board through the conductive pin, and the receiving holes of the conductive units are corresponded to each other. The conducting part of the first magnetic device pierces through the receiving hole of each of the conductive units and electrically connected to the conductive units.

In an embodiment, the integrated magnetic device further comprises a second magnetic device having a bobbin, a magnetic core assembly and the conductive units of the conductive structure.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 2:
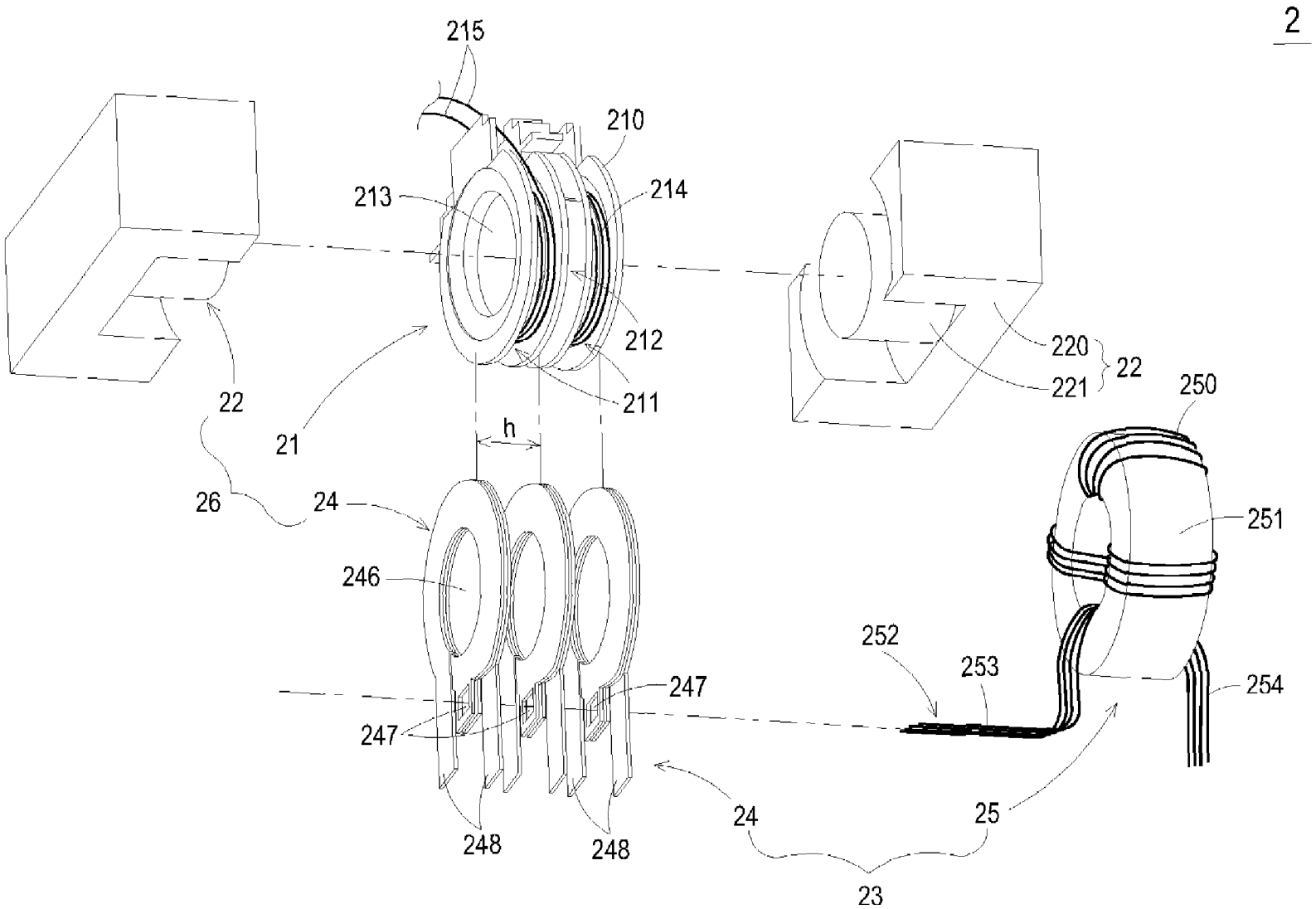
FIG. 2 is an explosion view showing the integrated magnetic device according to the first preferred embodiment of the present invention.
Figure 5:
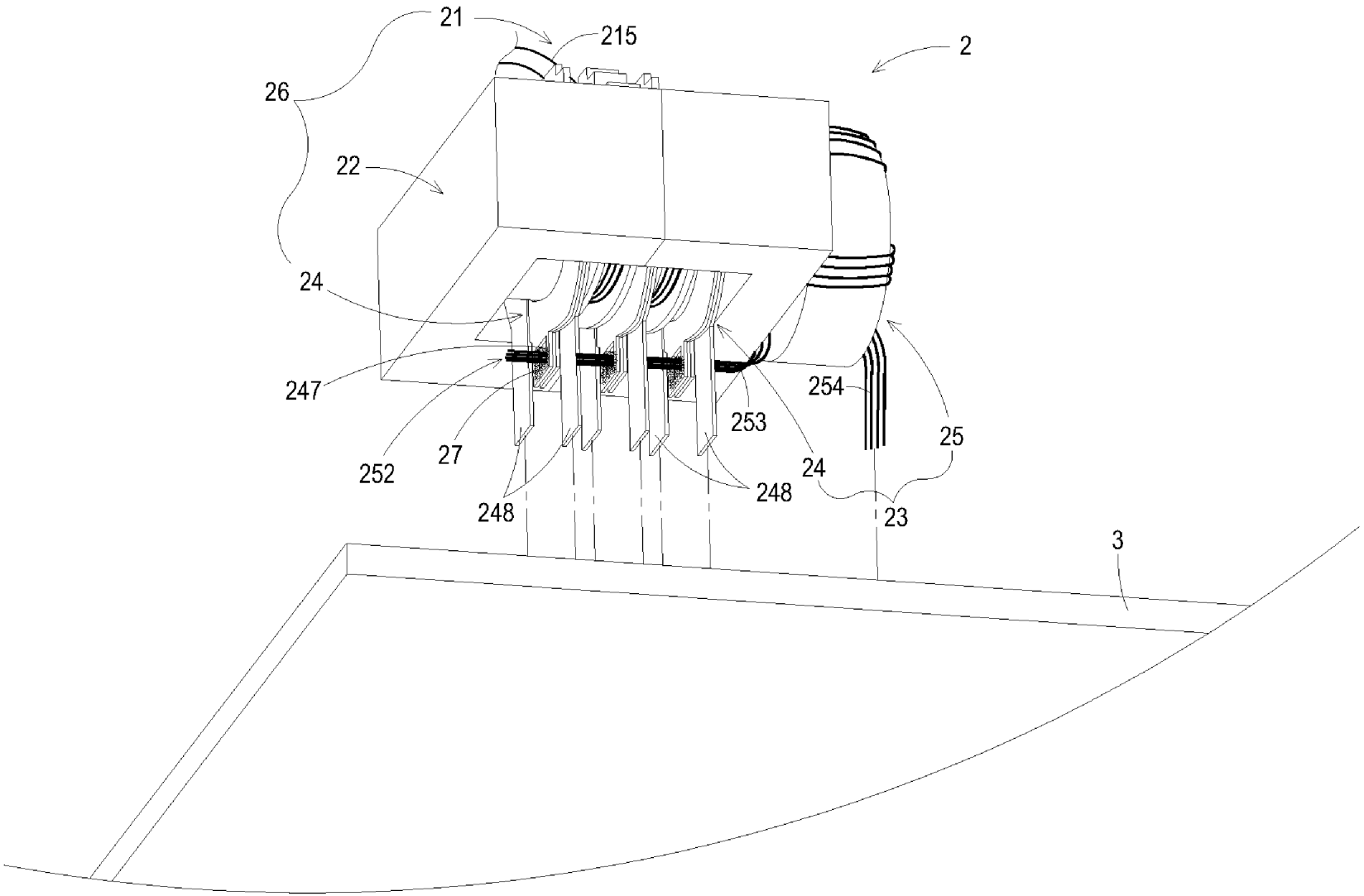
FIG. 5 illustrates the integrated magnetic device of FIG. 2 being assembled and disposed on the system circuit board.

Please refer to FIG. 2, which is an explosion view showing the integrated magnetic device according to the first preferred embodiment of the present invention. As shown in FIG. 2, the integrated magnetic device 2 comprises a bobbin 21, a magnetic core assembly 22, and a conductive structure 23, wherein the conductive structure 23 comprises plural conductive units 24 and a first magnetic device 25. The bobbin 21, the magnetic core assembly 22, and the conductive units 24 of the conductive structure 23 are assembled as a second magnetic device 26, and the first magnetic device 25 is connected to the conductive units 24. Thus the first magnetic device 25 and the second magnetic device 26 can be integrated as a single structure through the conductive units 24 of the conductive structure 23 (as shown in FIG. 5). In this embodiment, the first magnetic device 25 is preferred to be a choke coil, and the second magnetic device 26 is preferred to be a transformer, such as a flyback transformer, but not limited thereto.

Figure 3:
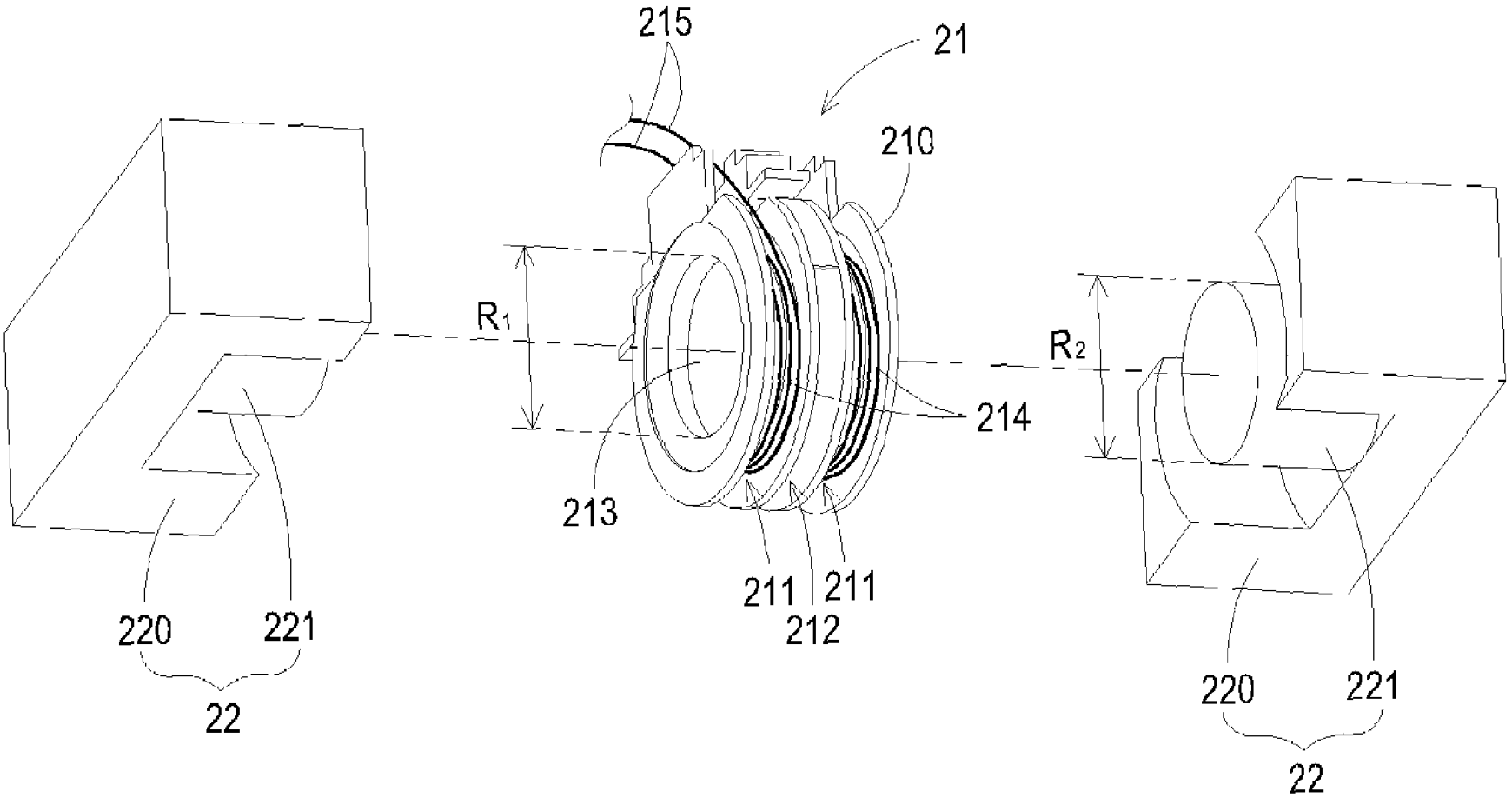
FIG. 3 illustrates the structures of the bobbin and the magnetic core assembly of the integrated magnetic device shown in FIG. 2.

Please refer to FIG. 3, which illustrates the structures of the bobbin and the magnetic core assembly of the integrated magnetic device shown in FIG. 2. As shown in FIG. 3, the bobbin 21 has a main body 210. The main body 210 can be a cylindrical structure formed by plastic injection molding, but the shape of the main body 210 is not limited. In other words, the cross-section of the main body 210 can be rectangular or polygonal (not shown). The main body 210 of the bobbin 21 has at least a winding section 211 and at least a receiving portion 212. In this embodiment, the main body 210 comprises two winding sections 211 and one receiving portion 212 disposed between the winding sections 211. The winding sections 211 and the receiving portion 212 are parallelly disposed on the main body 210. The numbers of the winding section 211 and the receiving portion 212 are not limited, which can be adjusted according to different requirements. The winding section 211 of the main body 210 is applied for the primary winding 214 to wind thereon, so as to receive the input current by the terminal 215 of the primary winding 214 connecting to the predetermined position, such as power output (not shown), on the system circuit board 3. The receiving portion 212 is applied for receiving parts of the secondary winding which generates inductive voltage, wherein the conductive units 24 are served as the secondary winding in this embodiment. The receiving portion 212 has an opening substantially larger then the diameter of the conductive unit 24, such as a semicircular opening, so parts of the conductive units 24 can be correspondingly inserted and received in the receiving portion 212. In addition, the bobbin 21 further comprises a channel 213 piercing through the main body 210 along the axis of the main body 210 and communicated with the receiving portion 212 for receiving parts of the magnetic core assembly 22. In this embodiment, the channel 213 can be a circular channel with diameter of R1, but not limited thereto.

Please refer to FIG. 3 again. The magnetic core assembly 22 has a first magnetic portion 220 and a second magnetic portion 221. In this embodiment, the magnetic core assembly 22 can be an EE-core assembly, wherein the second magnetic portion 221 can be cylindrical structure with diameter R2 substantially equal to the diameter R1 of the channel 213 of the bobbin 21. Therefore, the second magnetic portion 221 of the magnetic core assembly 22 can be received in the channel 213 of the bobbin 21. Of course, in some embodiments, the magnetic core assembly 22 can be replaced by an EI-core assembly or other kinds of magnetic core assembly. In other words, any magnetic core assembly 22 matching the bobbin 21 can be applied to the present invention.

Figure 4B:
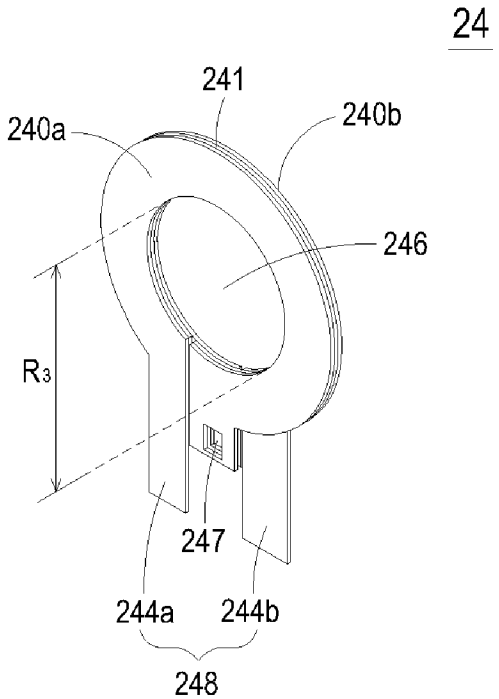
FIG. 4B is the schematic diagram showing the assembly of FIG. 4A.
Figure 4A:
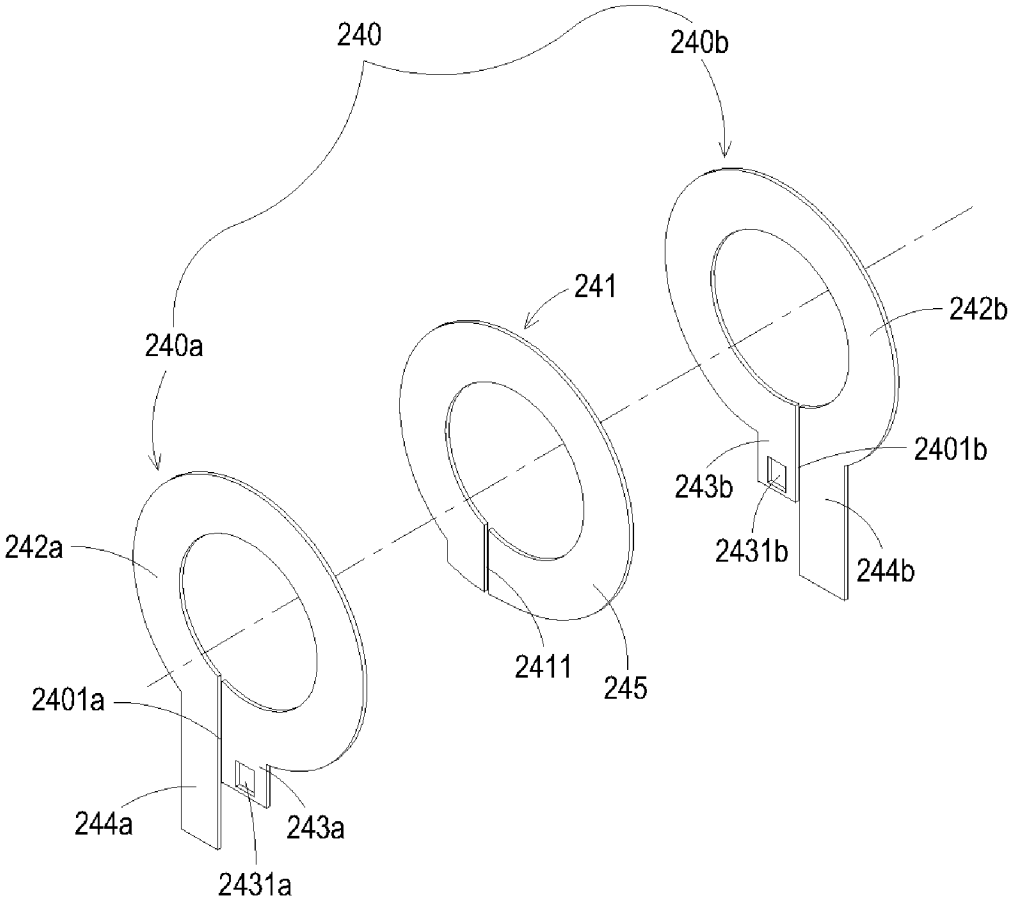
FIG. 4A is an explosion view of one of the conductive units of the conductive structure of the integrated magnetic device shown in FIG. 2.

FIG. 4A is an explosion view of one of the conductive units of the conductive structure of the integrated magnetic device shown in FIG. 2, and FIG. 4B is the schematic diagram showing the assembly of FIG. 4A. Please refer to FIG. 4A, FIG. 4B and FIG. 2, the conductive structure 23 comprises plural conductive units 24, each of the conductive units 24 has a hollow portion 246, a receiving hole 247, and at least a conductive pin 248 (as shown in FIG. 2). As shown in FIGS. 4A and 4B, each of the conductive units 24 comprises plural conductive pieces 240 and at least an insulating piece 241. In this embodiment, the conductive unit 24 has two conductive pieces 240, which are the first conductive piece 240*a* and the second conductive piece 240*b*, and one insulating piece 241. The insulating piece 241 is disposed between the first conductive piece 240*a* and the second conductive piece 240*b* (as shown in FIG. 4A).

Take the first conductive piece 240*a* for example, it can be formed by thin electrical conductive plate, such as thin metal plate and preferably copper or aluminum plate, but not limited thereto. The shape of the first conductive piece 240*a* can be separated into the loop portion 242*a*, the first extension portion 243*a*, and the second extension portion 244*a* (as shown in FIG. 4A). The shape of the loop portion 242*a* matches that of the cross-section of the main body 210 of the bobbin 21. In other words, the loop portion 242*a* is substantially a circular loop in this embodiment. However, the shape of the loop portion 242*a* is not limited, which can be modified as rectangular or polygonal loop depending on the main body 210 of the bobbin 21. In addition, the thin stripe first extension portion 243*a* and second extension portion 244*a* are coplanarly extended from the loop portion 242*a*. A through hole 2431*a* is disposed on the first extension portion 243*a*. The length of the second extension portion 244*a* is substantially longer than that of the first extension portion 243*a*. The first conductive piece 240*a* further has a gap 2401*a* extended from the loop portion 242*a* and along the line between the first extension portion 243*a* and the second extension portion 244*a*, so as to separate the first extension portion 243*a* and the second extension portion 244*a* via the gap 2401*a*. The shape and material of the second conductive piece 240*b* are the same as that of the first conductive piece 240*a*; in other words, the second conductive piece 240*b* also comprises a loop portion 242*b*, a first extension portion 243*b*, a through hole 2431*b*, a second extension portion 244*b*, and a gap 2401*b*, and thus it is not redundantly described here. As the insulating piece 241, it is made of insulating material. The insulating piece 241 also comprises a loop portion 245 and a gap 2411 cutting the loop portion 245; therefore, the loop portion 245 is not a close loop. The shape of the loop portion 245 of the insulating piece 241 is corresponded to that of the loop portions 242*a*, 242*b* of the first and second conductive pieces 240*a* and 240*b*.

Please refer to FIG. 4B, to assemble the conductive unit 24, the loop portion 242*a* and the through hole 2431*a* of the first extension portion 243*a* of the first conductive piece 240*a* are respectively aligned to the loop portion 242*b* and the through hole 2431*b* of the first extension portion 243*b* of the second conductive piece 240*b*, and the second extension portion 244*a* of the first conductive piece 240*a* and the second extension portion 244*b* of the second conductive piece 240*b* are staggered disposed. The insulating piece 241 is disposed between the first conductive piece 240*a* and the second conductive piece 240*b*, wherein the loop portion 245 of the insulating piece 241 is corresponded to the loop portion 242*a* of the first conductive piece 240*a* and the loop portion 242*b* of the second conductive piece 240*b*. Adhering media, such as adhesive (not shown), is applied for adhering the first conductive piece 240*a*, the second conductive piece 240*b*, and the insulating piece 241, so as to form the conductive unit 24 and isolate the conductive pieces 240 by the insulating piece 241.

Please refer to FIG. 4B, since the shape and size of the loop portions 242*a*, 245, and 242*b* of the first conductive piece 240*a*, the insulating piece 241, and the second conductive piece 240*b* are corresponded to each other, the hollow portion 246 of the conductive unit 24 can be defined thereby. The diameter R3 of the hollow portion 246 is substantially equal to the diameter R1 of the channel 213 of the bobbin 21. The receiving hole 247 of the conductive unit 24 is defined by the through hole 2431*a* of the first extension portion 243*a* of the first conductive piece 240*a* and the corresponded through hole 2431*b* of the first extension portion 243*b* of the second conductive piece 240*b*. As regards the second extension portions 244*a* and 244*b* of the first conductive piece 240*a* and the second conductive piece 240*b*, since the length thereof are longer than the length of the first extension portions 243*a* and 243*b*, the second extension portions 244*a* and 244*b* can be applied as the conductive pins 248 of the conductive unit 24 for connecting to the system circuit board 3 (as shown in FIG. 5). In addition, since the second extension portion 244*a* of the first conductive piece 240*a* and the second extension portion 244*b* of the second conductive piece 240*b* are staggered from each other, the conductive pins 248 of the conductive unit 24 are substantially extended from the opposite sides of the receiving hole 247, so as to form the conductive unit 24 shown in FIG. 4B. The conductive units 24 of the present invention are applied as the secondary winding of the second magnetic device 26, such as the secondary winding of the transformer. Accordingly, when two conductive pieces 240 have an insulating piece 241 disposed therebetween, the structure is similar to that having two windings. It is to be understood that the numbers of the conductive piece 240 and the insulating piece 241 of the conductive unit 24 can be adjusted per different requirements.

Please refer to FIG. 2 again; the first magnetic device 25 is preferred to be a choke coil, which is formed by the wire 250 wound on a magnetic core 251. In this embodiment, the magnetic core 251 can be a magnetic material with a ring shape, and the wire 250 can be enameled wire, but not limited thereto. The first magnetic device 25 also comprises a conducting part 252, which is a terminal 253 of the wire 250 of the first magnetic device 25 in this embodiment. The process for removing the enamel of the terminal 253 can be performed, and thus the terminal 253 can be served as the conducting part 252 to contact with the conductive units 24.

Please refer to FIG. 5 and FIG. 2, wherein FIG. 5 illustrates the integrated magnetic device of FIG. 2 being assembled and disposed on the system circuit board. As shown in FIG. 5 and FIG. 2, for assembling the integrated magnetic device 2, plural conductive units 24 and the first magnetic device 25 are assembled as the conductive structure 23, so as to apply the conductive structure 23 to the integrated magnetic device 2. The number of the conductive unit 24 is preferred to be two more than the number of the receiving portion 212 of the bobbin 21, but not limited thereto. For example, in this embodiment, the main body 210 of the bobbin 21 comprises one receiving portion 212, and thus three conductive units 24 can be applied in the integrated magnetic device 2. Of course, the number of the conductive unit 24 is not limited, which can be modified according to the requirement. While assembling the conductive structure 23, plural conductive units 24 are disposed corresponding to each other for aligning the hollow portion 246, the receiving hole 247, and the conductive pin 248 of each of the conductive units 24. An interval h is preserved between two adjacent conductive units 24, wherein the interval h is substantially greater than or equal to the width of the winding section 211 of the main body 210 of the bobbin 21. The terminal 253 of the first magnetic device 25 is applied as the conducting part 252 and successively pierces through the receiving hole 247 of each of the conductive units 24 along the direction parallel to the axis of the hollow portions 246 of the conductive units 24. The soldering process is performed at the receiving holes 247 to firmly secure the conducting part 252 in the receiving holes 247 of the conductive units 24 via the solder 27. Therefore, the first magnetic device 25 can be electrically connected to every conductive unit 24 through the conducting part 252 in contact with the receiving holes 247. Besides, since the receiving holes 247 can be filled with melted solder 27, the contact area between the conductive unit 24 and the conducting part 252 of the first magnetic device 25 can be increased, so as to enhance the structural strength of the conductive structure 23.

While assembling the conductive units 24 of the conductive structure 23 with the bobbin 21, the opposite outmost conductive units 24 are disposed at the opposite sides of the main body 210 of the bobbin 21, whereas the central conductive unit 24 is inserted and received in the receiving portion 212 of the main body 210 of the bobbin 21. Therefore, the main body 210 of the bobbin 21 can be used as partition to space the conductive units 24 from each other (as shown in FIG. 2). In addition, the hollow portions 246 of every conductive unit 24 are aligned with the channel 213 of the bobbin 21. Since the diameter R1 of the channel 213 substantially equals to the diameter R3 of the hollow portion 246, and the diameters R1 and R3 are substantially the same as the diameter R2 of the second magnetic portion 221 of the magnetic core assembly 22, the second magnetic portion 221 can pierce through the hollow portion 246 of each conductive unit 24 and the channel 213 of the bobbin 21 and being received therein. Thus the assembled structure of the conductive units 24 and the bobbin 21 can be disposed between the first magnetic portion 220 of the magnetic core assembly 22, thereby form the second magnetic device 26 by the bobbin 21, the magnetic core assembly 22, and the conductive units 24 of the conductive structure 23 (as shown in FIG. 5). The second magnetic device 26 is preferred to be a transformer, so as to generate inductive voltage by the conductive units 24 served as the secondary winding of the second magnetic device 26 basing on electromagnetic induction and perform the function of transformer to regulate voltage. Accordingly, the first magnetic device 25 and the second magnetic device 26 can be integrated as the integrated magnetic device 2 shown in FIG. 5 through the conductive units 24 of the conductive structure 23. Of course, adhering media, such as adhesive (not shown), can be selectively applied between the first magnetic device 25 and the magnetic core assembly 22 adjacent thereto for securely fixing the first magnetic device 25 on the magnetic core assembly 22.

Figure 1:
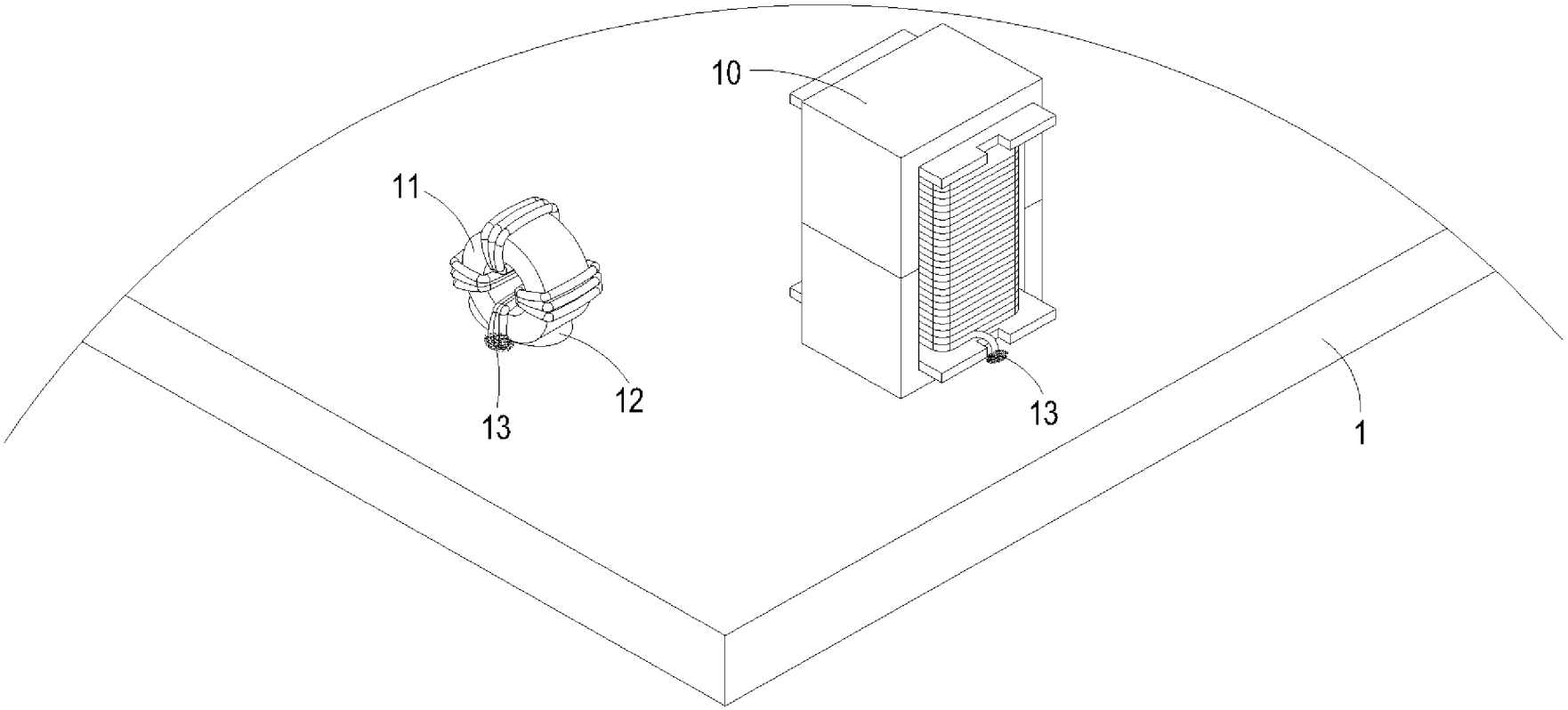
FIG. 1 PRIOR ART
FIG. 1 is a schematic diagram showing the conventional transformer and choke coil disposed on the system circuit board.

Please refer to FIG. 5 again, the integrated magnetic device 2 is directly disposed on the predetermined position on the system circuit board 3 through the conductive pins 248 of each conductive unit 24 of the conductive structure 23, so as to electrically connect to the system circuit board 3 of the electronic equipment or the electronic apparatus. For example, the conductive pins 248 can be inserted into the predetermined holes (not shown) on the system circuit board 3, but not limited thereto. In other words, the second extension portions 244*a* and 244*b* of the conductive pieces 240 of each conductive unit 24 are directly disposed on the system circuit board 3. Of course, the terminal 215 of the primary winding 214 of the bobbin 21 can be connected to the predetermined position, such as power output (not shown), on the system circuit board 3, and the other terminal 254 of the first magnetic device 25 can be connected to the system circuit board 3 as well. Hence the inductive voltage can be generated by the conductive units 24 applied as secondary winding when the current is received by the primary winding 214. The inductive voltage is directly transferred from the central tapped of the second magnetic device 26, which is formed by the receiving holes 247 of the conductive units 24, to the first magnetic device 25 through the conducting part 252. Therefore, the current resistance and waste caused by connecting the transformer 10 and choke coil 11 via the trace of the system circuit board 1 in the conventional technique (as shown in FIG. 1) can be avoided. Besides, the space utility of the system circuit board 3 can be raised by the integration of the first magnetic device 25 and the second magnetic device 26. In some embodiments, the conductive pins 248 of each of the conductive units 24 of the conductive structure 23 can be disposed on the system circuit board 3 prior than assembling with the bobbin 21 and the magnetic core assembly 22. That is to say, the integrated magnetic device 2 can be disposed on the system circuit board 3 by different means, and the purpose for integrating the first and second magnetic devices 25 and 26 is not affected.

Figure 6:
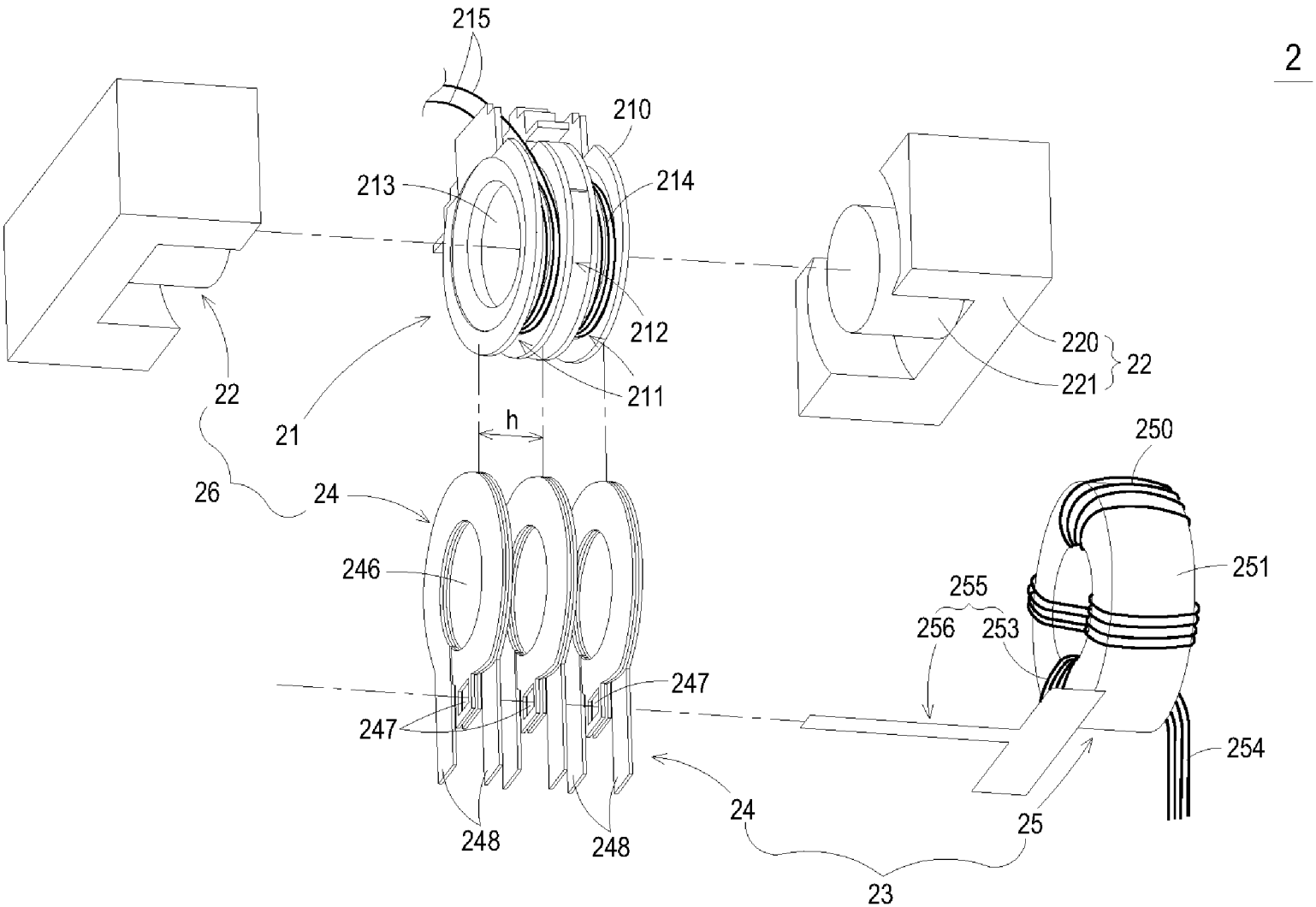
FIG. 6 is an explosion view showing the integrated magnetic device according to the second preferred embodiment of the present invention.
Figure 7:
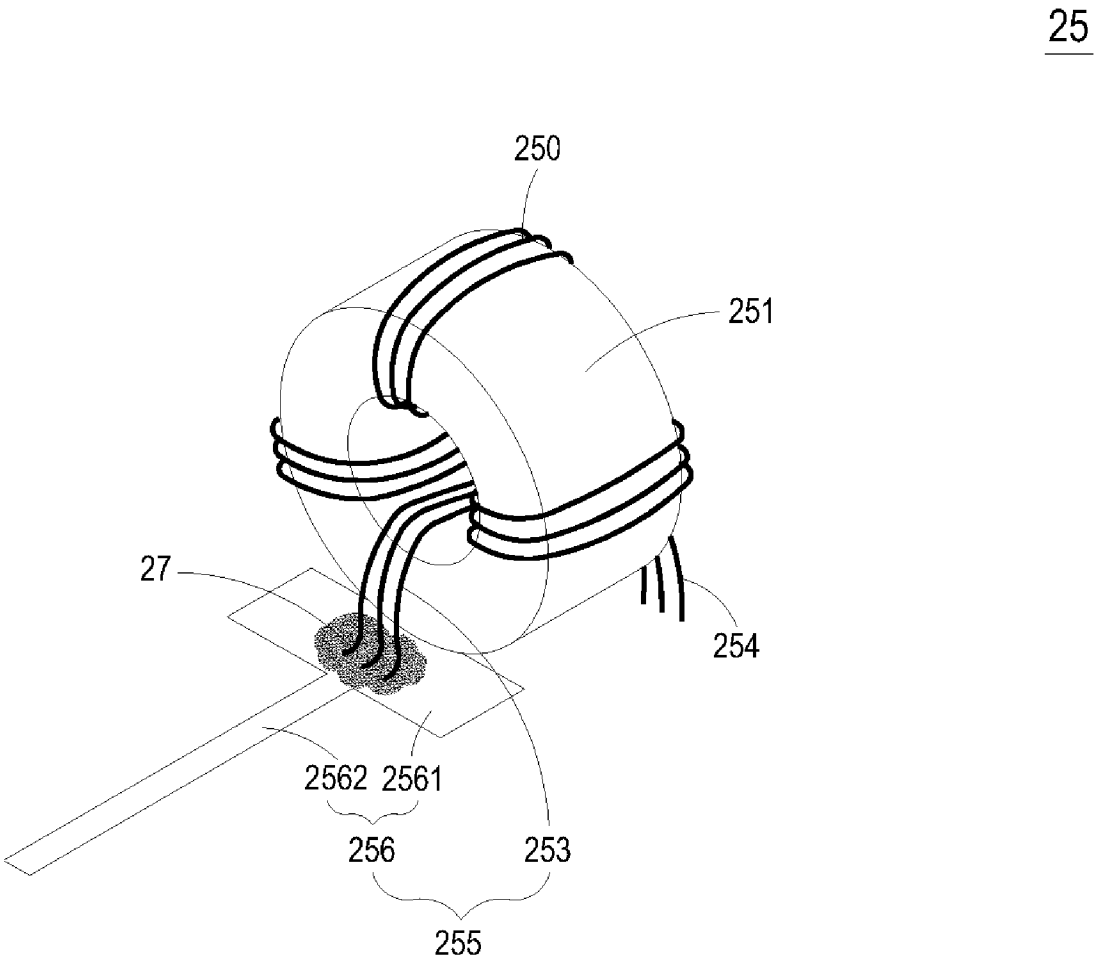
FIG. 7 is a schematic diagram showing the first magnetic device of FIG. 6.
Figure 8:
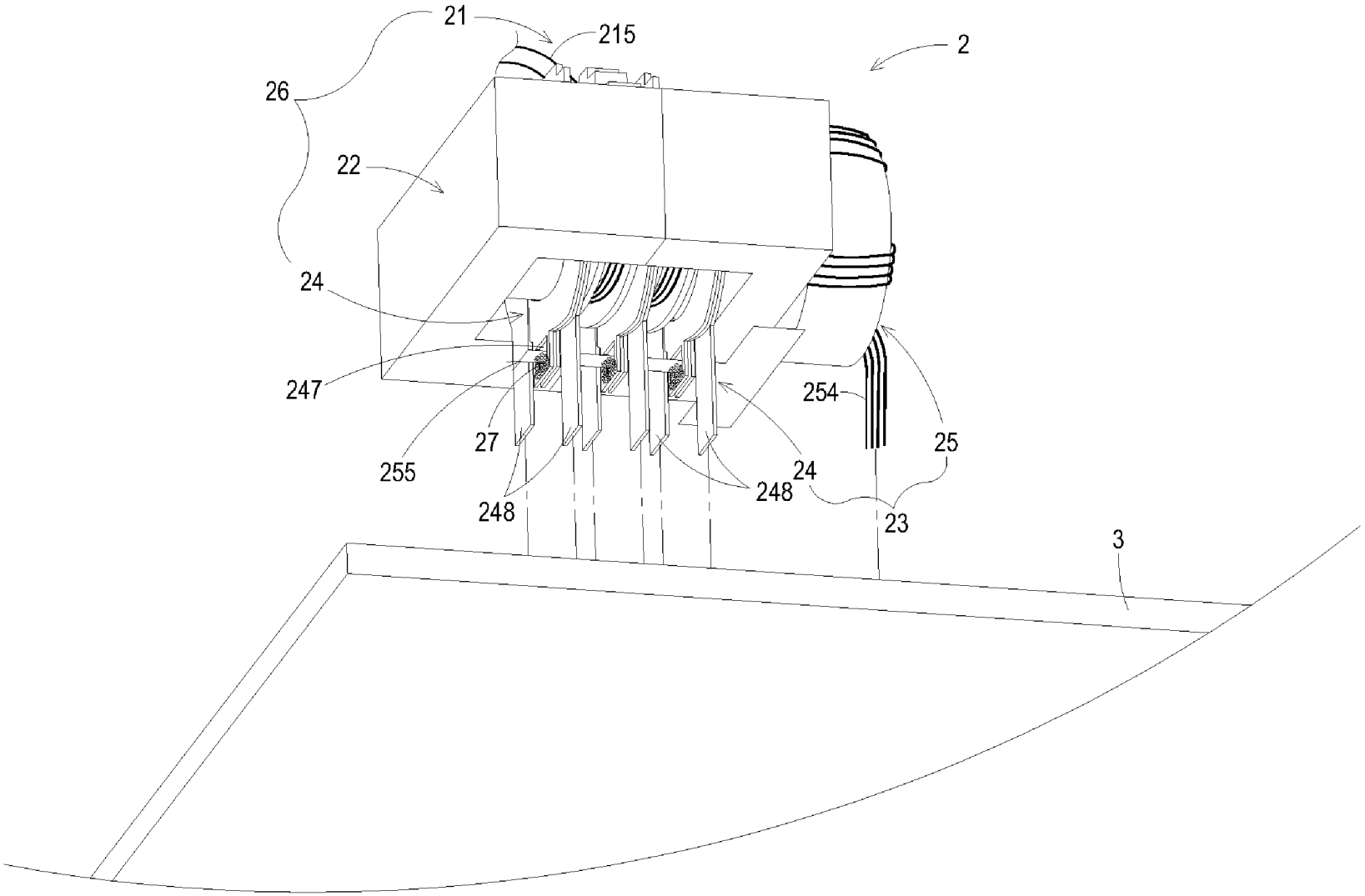
FIG. 8 illustrates the integrated magnetic device of FIG. 6 being assembled and disposed on the system circuit board.

Of course, the present invention is not limited to the foregoing embodiments. Please refer to FIG. 6, which is an explosion view showing the integrated magnetic device according to the second preferred embodiment of the present invention. As shown in FIG. 6, the integrated magnetic device 2 comprises a bobbin 21, a magnetic core assembly 22, and a conductive structure 23, wherein the conductive structure 23 has a plurality of conductive units 24 and a first magnetic device 25. The structures of the bobbin 21, the magnetic core assembly 22 and the conductive units 24 are the same as that of the first embodiment shown in FIGS. 2, 3, 4A and 4B, and thus it is not redundantly described. The first magnetic device 25 is preferred to be a choke coil, wherein the wire 250 and magnetic core 251 are similar to that of the first magnetic device 25 shown in FIG. 2, except the conducting part 255. In this embodiment, the conducting part 255 of the first magnetic device 25 comprises not only the terminal 253 but also a conductive stripe 256. The conductive stripe 256 can be formed by conductive material, such as metal plate of copper, aluminum, or etc. The conductive stripe 256 has a first area 2561 and a second area 2562 perpendicular to each other. In other words, the conductive stripe 256 is substantially a T-shape structure, and the width of the second area 2562 is substantially smaller than or equal to the width of the receiving hole 247 of the conductive unit 24. The terminal 253 of the first magnetic device 25 is connected to the first area 2561 of the conductive stripe 256 through solder 27 (as shown in FIG. 7), and the second area 2562 of the conductive stripe 256 pierces through the receiving holes 247 of the conductive units 24 along the direction parallel to the axis of the hollow portions 246 of the conductive units 24 and being received in the receiving holes 247. The second area 2562 of the conductive stripe 256 can be firmly fixed in the receiving holes 247 via the solder 27. Therefore, the first magnetic device 25 and plural conductive units 24 can be assembled as the conductive structure 23, and the first magnetic device 25 is electrically connected to the conductive units 24 through the terminal 253 and the conductive stripe 256 of the conducting part 255 (as shown in FIG. 8). Of course, it is to be understood that the shape of the conductive stripe 256 is not limited. The conductive stripe 256 can be a straight metal sheet with equal width or a metal rod (not shown). In other words, the conductive material with the shape which can pierce through the receiving holes 247 of the conductive units 24 can be used as the conductive stripe 256 of the present invention. In addition, positioning protrusion or positioning indentation (not shown) can be disposed on the second area 2562 of the conductive stripe 256 to assist positioning the conductive units 24 relative to the conductive stripe 256.

Please refer to FIG. 8 and FIG. 6, wherein FIG. 8 illustrates the integrated magnetic device of FIG. 6 being assembled and disposed on the system circuit board. Similarly, while the bobbin 21, the magnetic core assembly 22, and the conductive structure 23 are assembled as the integrated magnetic device 2, the opposite outmost conductive units 24 are disposed at the opposite sides of the main body 210 of the bobbin 21, and the central conductive unit 24 is inserted and received in the receiving portion 212 of the main body 210 of the bobbin 21. The hollow portions 246 of the conductive units 24 are corresponded to the channel 213 of the bobbin 21, so as to receive the second magnetic portion 221 of the magnetic core assembly 22. As regards the relationships among the bobbin 21, the magnetic core assembly 22, and the conductive structure 23, they are similar to that of the first preferred embodiment shown in FIG. 2 and FIG. 5, and thus it is not redundantly described. Accordingly, the bobbin 21, the magnetic core assembly 22 and the conductive units 24 of the conductive structure 23 form the second magnetic device 26 of the integrated magnetic device 2. The second magnetic device 26 is preferred to be a transformer, but not limited thereto. Similarly, plural conductive units 24 can be served as connecting media to integrate the first magnetic device 25 and the second magnetic device 26 as a single integrated magnetic device 2. The integrated magnetic device 2 is directly disposed on the system circuit board 3 via the conductive pins 248 of each of the conductive units 24 of the conductive structure 23, so as to electrically connect to the system circuit board 3. The terminal 215 of the primary winding 214 of the bobbin 21 can be electrically connected to the predetermined position, such as power output (not shown), on the system circuit board 3 to receive power, and the terminal 254 of the first magnetic device 25 can be electrically connected to the system circuit board 3 as well. Thus the power can be received by the primary winding 214 of the second magnetic device 26, and the inductive voltage can be generated by the conductive units 24 served as the secondary winding. The inductive voltage can be transferred not only to the system circuit board 3 through the conductive pins 248 for driving other electronic devices, such as transistors (not shown), but also to the first magnetic device 25 directly through conducting part 255 in contact with the central tapped formed by the receiving holes 247 of the conductive units 24.

According to the foregoing description, it is to be understood that in the foregoing preferred embodiments, the structure of the conductive unit 24 is illustrated by the example of two conductive pieces 240 and one insulating piece 241. The second magnetic device 26 is illustrated by the example of three conductive units 24 in cooperate with the main body 210 of the bobbin 21 having one receiving portion 212. Nevertheless, the numbers of the conductive piece 240 and the insulating piece 241 of the conductive unit 24 and the number of the conductive unit 24 of the conductive structure 23 are not limited, which can be adjusted per different requirements. In addition, the conductive unit 24 can be formed not only by adhering the independent first and second conductive pieces 240*a* and 240*b* but also by folding the same conductive plate to form the first and second conductive pieces 240*a*, 240*b*. Moreover, the integrated magnetic device 2 can be a horizontal-type integrated magnetic device 2 with magnetic core assembly 22 disposed on the system circuit board 3 side by side (as shown in FIG. 5 and FIG. 8), or a vertical-type one (not shown) with magnetic core assembly 22 piled up relative to the system circuit board 3 in some other embodiments. The advantages of the present invention are not affected by the different types of the integrated magnetic device 2.

Besides, the integrated magnetic device 2 can be disposed on the system circuit board 3 not only by the conductive pins 248 of the conductive units 24 inserted into the predetermined position on the system circuit board 3 (as shown in FIGS. 5 and 8), but also by the conductive pins 248 surface mounted on the system circuit board 3 via surface mount technique (SMT). In other words, the means for structurally and electrically connecting the integrated magnetic device 2 and the system circuit board 3 by the conductive pins 248 of every conductive unit 24 all belongs to the disclosure of the present invention.

To sum up, the conductive part of the first magnetic device is directly piercing through the receiving hole of each of the conductive units, so the first magnetic device can be integrated with and electrically connected to the conductive units. The conductive units are disposed at the opposite sides of the main body of the bobbin and inserted into the receiving portion of the main body to serve as the secondary winding of the second magnetic device. The conductive units can be further positioned relative to the bobbin by the magnetic core assembly, and thus the second magnetic device is formed. Accordingly, the first and second magnetic devices can be integrated as the integrated magnetic device through the conductive units of the conductive structure, so as to increase the space utility of the system circuit board. The trend of decreasing the volume and increasing the power of the electronic equipment or electronic apparatus can be matched as well.

Besides, since the first magnetic device is directly connected to the central tapped of the second magnetic device, the inductive voltage generated by the second magnetic device can be transferred to the first magnetic device directly. That is to say, the connection via the trace of the system circuit board is no longer necessary, and thus the current resistance and waste can be effectively lowered.

Moreover, the conducting part can be directly connected with each of the conductive units of the conductive structure to form the conductive structure after the wire is wound on the magnetic core of the first magnetic device, and the primary winding can be wound on the winding section of the bobbin in advance as well. Therefore, it is to be understood that the process for assembling the bobbin, the magnetic core assembly, and the conductive units as the second magnetic device is simple, and the first and second magnetic devices can be integrated while assembling the second magnetic device. Besides, since the integrated magnetic device is soldered to the system circuit board via the conductive pins of the conductive units extended from the integrated magnetic device, the damages to the insulating material of the wires wound on the first magnetic device and the bobbin of the second magnetic device and the drawbacks caused by the high temperature during soldering process applied in the conventional technique can be avoided as well.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An integrated magnetic device disposed on a system circuit board, said integrated magnetic device comprising:

a bobbin having a main body for a primary winding to wind thereon and a channel piercing through said main body;

a magnetic core assembly; and a conductive structure comprising:

a plurality of conductive units corresponded to each other, each of which comprising a hollow portion, a receiving hole, and at least a conductive pin; and a first magnetic device comprising a conducting part, said conducting part piercing through said receiving hole of each of said conductive units and electrically connected to said conductive units;

wherein said conductive units of said conductive structure are spaced by said main body of said bobbin, and said hollow portion of each of said conductive units is corresponded to said channel of said bobbin to receive parts of said magnetic core assembly, so as to assemble said bobbin, said magnetic core assembly and said conductive units of said conductive structure as a second magnetic device, said first magnetic device and said second magnetic device are integrated by said conductive structure and disposed on said system circuit board through said conductive pin of each of said conductive units of said conductive structure.

2. The integrated magnetic device according to claim 1, wherein said first magnetic device is a choke coil.

3. The integrated magnetic device according to claim 1, wherein said second magnetic device is a transformer.

4. The integrated magnetic device according to claim 1, wherein said main body of said bobbin further comprises at least a winding section and at least a receiving portion, said primary winding is wound on said winding section, and said conductive units of said conductive structure are disposed at opposite sides of said main body and received in said receiving portion of said main body.

5. The integrated magnetic device according to claim 1, wherein said conductive units are secondary winding of said second magnetic device.

6. The integrated magnetic device according to claim 1, wherein each of said conductive units comprises:

a plurality of conductive pieces, each of which having a loop portion, a first extension portion, and a second extension portion, said first extension portion having a through hole, and said second extension portion being substantially longer than said first extension portion; and an insulating piece having a loop portion and being disposed between said conductive pieces, said loop portion of said insulating piece being corresponded to said loop portion of each of said conductive pieces for defining said hollow portion of each of said conductive units, said through holes of said first extension portions of said conductive pieces being corresponded to each other for defining said receiving hole of each of said conductive units, and said second extension portion of each of said conductive pieces being applied as said conductive pin of each of said conductive units.

7. The integrated magnetic device according to claim 6, wherein said second extension portions of said conductive pieces are staggered from each other in each of said conductive units.

8. The integrated magnetic device according to claim 1, wherein said conducting part of said first magnetic device is a terminal of said first magnetic device.

9. The integrated magnetic device according to claim 1, wherein said conducting part of said first magnetic device comprises a conductive stripe and a terminal of said first magnetic device, said terminal is connected to said conductive stripe, and said conductive stripe pierces through said receiving hole of each of said conductive units.

10. The integrated magnetic device according to claim 9, wherein said conductive stripe is selected from a metal material.

* * * * *